US005566979A

United States Patent [19]

Ong

[11] Patent Number: 5,566,979

[45] Date of Patent: Oct. 22, 1996

[54] DOCUMENT HOLDER INSERT

[76] Inventor: Bon S. Ong, P.O. Box 4247, Torrance, Calif. 90510

[21] Appl. No.: 349,563

[22] Filed: Dec. 5, 1994

[51] Int. Cl.[6] ..... B42D 1/00

[52] U.S. Cl. ..... 281/21.1; 281/15.1; 281/28

[58] Field of Search ..... 281/45, 46, 47, 281/49, 21.1, 15.1, 43, 28, 51

[56] References Cited

U.S. PATENT DOCUMENTS

| | | | |
|---|---|---|---|
| 2,388,960 | 11/1945 | Einzig | 281/47 |
| 2,960,090 | 11/1960 | Shugant | 281/47 |

FOREIGN PATENT DOCUMENTS

| | | | |
|---|---|---|---|
| 1190938 | 10/1959 | France | 281/47 |
| 417207 | 10/1934 | United Kingdom | 281/47 |

*Primary Examiner*—Willmon Fridie, Jr.
*Attorney, Agent, or Firm*—Charles H. Thomas

[57] ABSTRACT

An insert is provided for a bifolding folder having front and back covers. The insert is a holder for a multipage document or other soft-covered document, such as a magazine, bound by staples or adhesive along its spine. The holder of the invention is formed as a stiff, elongated, flat strip with a narrow, elongated document slot defined therewithin. The document slot receives substantially half of the pages of the soft document, which is held to the strip by a retaining bar on one side of the slot. The holder also includes an attachment hinge joined to the strip and having elongated, longitudinally extending anchoring and holder attachment leaves. The holder attachment leaf is secured to the strip along its length by adhesive or other types of fasteners. The anchoring leaf may have a layer of adhesive disposed thereon or it may be formed of a heat sealable material. The anchoring leaf is adapted for attachment to the inside surface of either the front or back cover of the folder. The holder insert of the invention thereby allows a conventional folder to be modified so as to secure a magazine or other bound, soft-covered document therein in such a manner as to permit access to all of the pages of the document.

18 Claims, 5 Drawing Sheets

DOCUMENT HOLDER INSERT

BACKGROUND OF THE INVENTION

1. Field of the Invention

The present invention relates to a holder for carrying a soft-covered document thereon which is insertable and attachable to the inside of a folder.

2. Description of the Prior Art

Among the different types of office supplies available, folders are widely used for carrying numerous different types of documents. One very common type of folder which has a simple construction is formed of a sheet of stiff paper or card stock folded down its center to form a front and back cover. Such a folder forms a protective jacket for papers to be carried. A conventional folder of this type may include only the front and back covers with no additional structure, although frequently the sheet forming the folder is configured to create pockets and sometimes reinforcing edges on the inside surfaces of either the front cover, the back cover, or both.

While conventional folders of this type ace perfectly adequate for carrying and protecting unbound papers of standard sizes, they have proven inadequate for carrying multipage soft-covered documents which themselves have front and back covers. Typically, such soft-covered documents are formed of a number of sheets of paper which are folded lengthwise to create two pages out of each sheet. The folded sheets are nested one inside another and bound along their central fold line by staples or adhesives to form a spine. Magazines are typically constructed in this manner as are different types of promotional brochures, business reports, catalogs, and other such documents.

Soft documents of this type cannot be conveniently carried in conventional folders. If multipage soft documents, such as magazines are carried loose between the front and back covers of a folder, they will often fall out of the folder. If they are positioned in pockets of the folder, they still will sometimes fall out of the folder, and in any event are rendered somewhat inaccessible since they must be removed from the pocket for perusal.

SUMMARY OF THE INVENTION

The present invention provides a holder for a soft, bound document which can be quickly and easily inserted into an otherwise conventional folder to form a part thereof. The document holder insert of the invention provides a means for readily mounting any number of soft documents within a conventional folder.

The holder of the invention is formed of two primary elements. Specifically, the first element of the holder of the invention is formed of an elongated strip of stiff material that defines therethrough an elongated document slot bounded about its entire perimeter by the structure of the stiff material. The document slot delineates the strip of stiff material into an elongated document retaining bar and an attachment margin. To utilize the device a soft, bound document, such as a magazine, is opened, preferably to its center pages. Half of the pages are then inserted through the document slot so that the first half of the soft document resides on one side of the retaining bar facing the front cover while the last half of the document resides on the other side of the retaining bar facing the back cover.

The other element of the holder is an elongated hinge that has mutually parallel anchoring and mounting leaves. The mounting leaf of the hinge is attached to the elongated strip of stiff material throughout its length in a permanent fashion. The anchoring leaf is used to secure the holder to the inside of either the front or back cover of the folder. Preferably, the anchoring leaf is coated with an adhesive throughout its length. Prior to use this strip of adhesive is preferably covered with a release paper backing that prevents the adhesive from sticking to any material with which it comes in contact prior to deployment for use.

Alternatively, the anchoring leaf and the folder can be constructed of materials that can be heat sealed together. For example, the anchoring leaf and at least one cover of the folder can be constructed of polyvinyl chloride (PVC), polyethylene (PE), or polypropylene (PP). In this case no adhesive layering is required. Rather, the anchoring leaf is merely placed in contact with one cover of the folder and heat is applied along the length thereof. The anchoring leaf and folder ore thereby permanently fused together.

When the holder is to be used, the release paper backing is pulled free of the adhesive on the anchoring leaf. The anchoring leaf is then positioned adjacent to the longitudinal center of the folder and pressed into contact with the inside surface of either the front or back cover of the folder. The pressure sensitive adhesive secures the anchoring leaf of the elongated hinge to the structure of the folder, while the articulated mounting leaf carrying the elongated strip of stiff material thereon can be rotated throughout a substantial arc relative to the anchoring leaf.

The document holder insert of the invention may be employed as a single insert into a folder. Alternatively, several different document holders constructed according to the invention may be attached to the inside covers of the same folder to mount a plurality of soft, bound documents therein. Each holder carries a single, separate, soft-bound document thereon and can be moved in articulated fashion relative to the covers of the folder. All of the holders may be attached to the inside surface of the same cover. Alternatively, some holders may be attached to the inside surface of the back cover while others may be attached to the inside surface of the front cover of the folder.

In one broad aspect the present invention may be considered to be a holder for a soft-covered document comprising a flat, elongated strip of stiff material defining therethrough an elongated document slot bounded about its entire perimeter by the stiff material. The slot is of a configuration suitable for receiving some of the pages of the document therethrough such that they reside on one side of the strip while the remainder of the pages reside on the other side of the strip. The holder also includes an elongated attachment hinge having elongated, longitudinally extending anchoring and holder attachment leaves. The holder attachment leaf is secured to the strip along the length thereof. The anchoring leaf may have a layer of adhesive disposed thereon along its length. On the other hand it may be secured to the folder by heat sealing. In any event, the anchoring leaf is securable to the inside of a folder cover.

In another broad aspect the invention may be considered to be a combination of a folder formed with front and back covers, each having an interior and an exterior surface, and an elongated holder for soft documents. The elongated holder includes an elongated, stiff, flat, member. The flat member defines entirely within its structure a narrow, elongated document slot that delineates an elongated document retaining bar and an attachment margin. The retaining bar and attachment margin are joined together at opposite, longitudinally separated ends. The document holder further includes an elongated hinge with elongated, mutually parallel anchoring and mounting leaves joined together in articulated fashion throughout their lengths. The mounting leaf is secured throughout its length to the attachment margin of the stiff, flat member and the anchoring leaf is secured throughout is length to at least one of the inside surfaces of the front and back covers.

In still another broad aspect the invention may be considered to be an insert for a folder having front and back covers comprising a holder for a multipage document formed with a stiff, elongated strip having longitudinally opposite ends and opposite flat sides and defining therewithin and therethrough a narrow, elongated document slot. The document slot is of a size that receives therethrough a substantial number of pages of the document. The substantial number of pages project from one of the sides of the strip and the remaining pages of the document project from the other side of the strip. The holder also includes an attachment hinge secured to the strip and having elongated, longitudinally extending anchoring and holder attachment leaves. The holder attachment leaf is secured to the strip along its length. The anchoring leaf may have a layer of adhesive disposed thereon for adhesive attachment to one of the covers of the folder.

The invention may be described with greater clarity and particularity by reference to the accompanying drawings.

DESCRIPTION OF THE EMBODIMENTS

Figure 1:
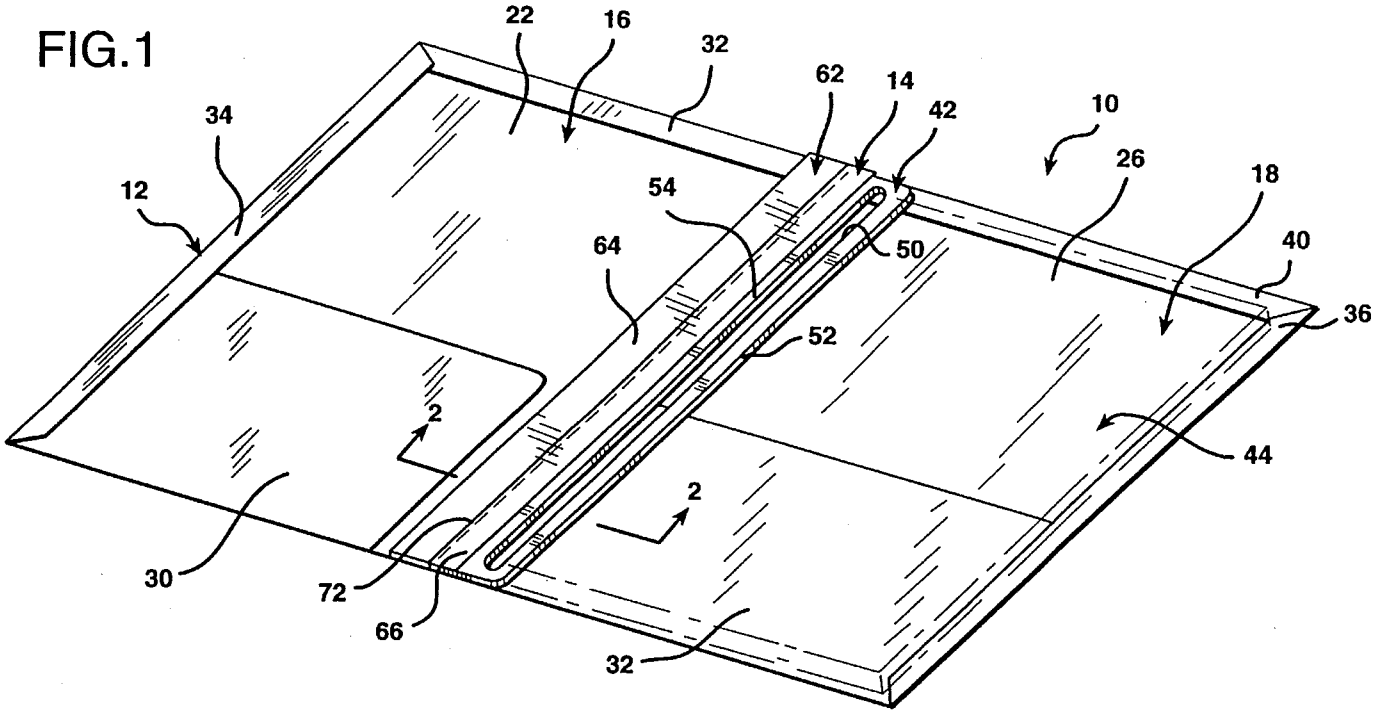
FIG. 1 is a perspective view of a folder and document holder combination according to the invention.

FIG. 1 illustrates a folder and document holder combination generally at 10. The combination 10 employs a folder 12 and a document holder 14. The folder 12 is formed of a single sheet of thick paper stock which may have either a glossy or matte finish. The sheet of thick paper stock is die cut and folded to form a front cover 16 and a back cover 18 which are delineated from each other by a fold line 20 that bifurcates the structure of the folder 12 and forms the delineation between the front cover 16 and the back cover 18. The front cover 16 has an inside surface 22 and an outside surface 24. Likewise, the back cover 18 has an inside surface 26 and an outside surface 28. The stock forming the folder 12 also forms front and back cover pockets 30 and 32, respectively, and also a reinforcing front cover side edge border 34, a rear cover side edge border 36, a reinforcing front cover top edge border 38, and a reinforcing back cover top edge border 40. The folder 12, by itself, is of a conventional type readily available from office supply distribution centers.

Figure 2:
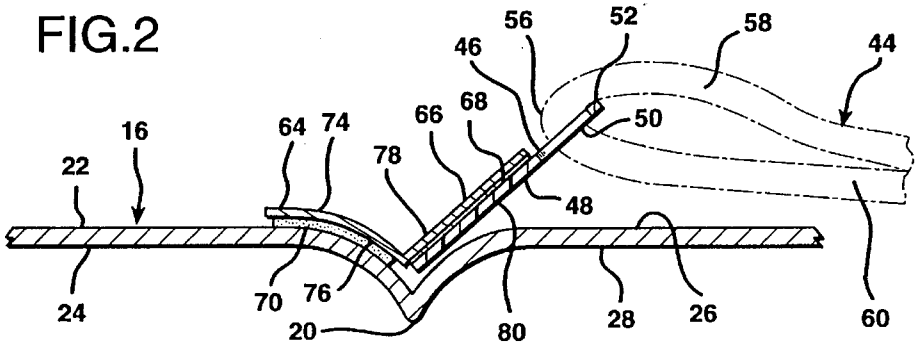
FIG. 2 is a section detail taken along the lines 2—2 of FIG. 1.

The document holder 14 is comprised of a thin, stiff, flat, elongated strip 42, which may be formed of plastic, wood, metal, or any other material that is considerably stiffer than a soft document, such as the magazine 44 illustrated in phantom in FIGS. 1 and 2, to be retained therewithin. The elongated strip 42 has opposing flat sides 46 and 48 and defines an elongated, narrow, linear document slot 50 entirely therewithin. The slot 50 extends entirely through the thickness of the member 42 between the opposite flat sides 46 and 48 thereof. The slot 50 delineates an elongated document retaining bar 52 and a parallel, elongated attachment margin 54. The retaining bar 52 and the attachment margin 54 are joined together at their opposite longitudinally separated ends so that the slot 50 is defined entirely within the structure of the member 42. That is, the slot 50 is an enclosed slot and is not open at either end. Its perimeter lies entirely within the structure of the member 42.

The size of the slot 50 is selected so that the slot 50 receives therethrough a substantial number of the pages of the magazine 44. Preferably, the magazine 44 is opened at its center pages where the staples binding the sheets of the magazine pages together are typically visible. One-half of the pages of the magazine 44 are then inserted into the slot 50 and pulled therethrough until the binding 56 of the magazine 44 resides substantially within the slot 50, as illustrated in FIG. 2. The pages of the magazine 44 are thereby split into two sections 58 and 60. The sections 58 and 60 preferably have an equal number of pages, whereby the innermost pages residing in contact with the structure of the folder member 42 on the opposite sides 46 and 48 thereof are formed by different portions of the same folded center sheet of the magazine 44. This facilitates insertion of the magazine pages through the slot 50.

The document holder 14 further includes an elongated hinge 62. The hinge 62 has an anchoring leaf 64 and a mounting leaf 66 which are mutually parallel to each other and joined in articulated fashion throughout their lengths. The mounting leaf 66 of the elongated hinge 62 is secured throughout its length to the attachment margin 54 of the document holder member 42 by a layer of pressure sensitive adhesive 68. Similarly, the anchoring leaf 64 is secured throughout its length to the inside surface 22 of the front cover 16 by a different adhesive layer 70.

Figure 3:
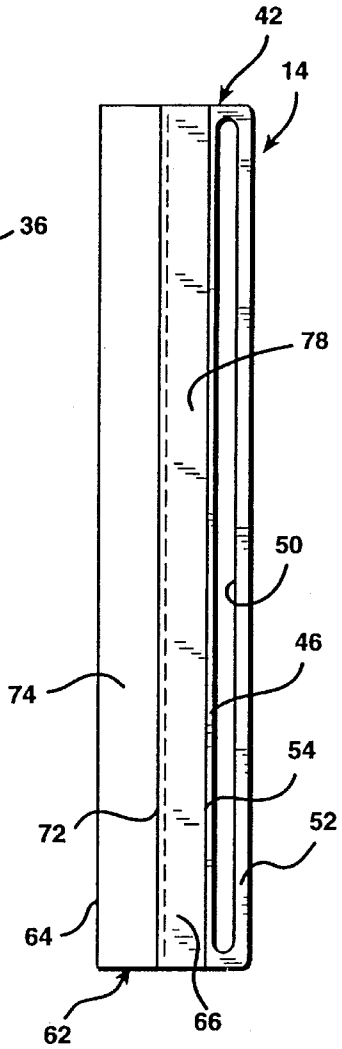
FIG. 3 is a top plan view of the document holder employed in the combination of FIGS. 1 and 2, shown in isolation.
Figure 4:
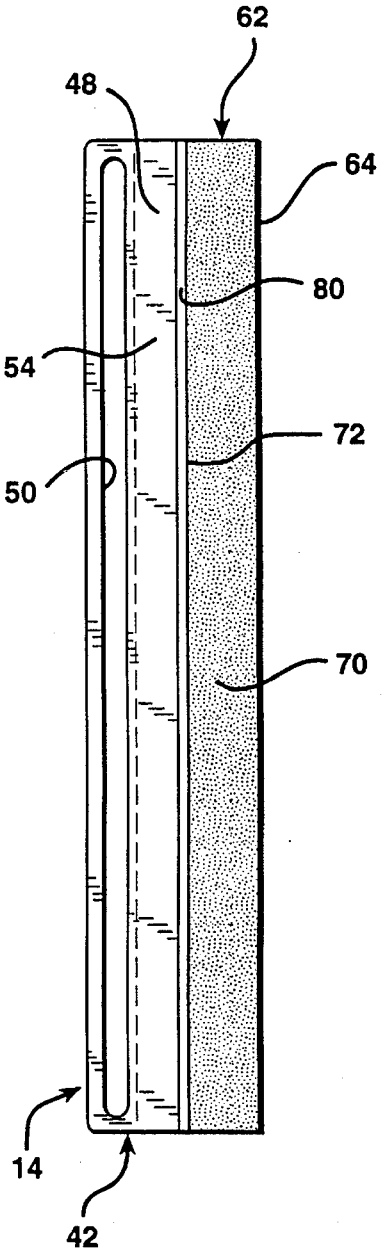
FIG. 4 is a bottom plan view of the document holder employed in the combination of FIGS. 1 and 2, shown in isolation.

The elongated hinge 62 may be formed as a unitary, thin, flat structure from card stock material divided longitudinally by a fold line 72, as shown in FIGS. 3 and 4. Each of the leaves 64 and 66 of the hinge 62 has a top side and an underside. The top side of the leaf 64 is indicated at 74, while the underside thereof is indicted at 76. The opposing leaf 66 has a top side 78 and an underside 80.

As illustrated in FIG. 2, the anchoring leaf 64 has a layer of adhesive 70 on its underside 76 and is secured to the inside surface 22 of the front cover 16 of the folder 12 by the adhesive layer 70. The anchoring leaf 64 is thereby firmly anchored and secured to the inside surface 22 of the front cover 16 throughout its entire length and carries the mounting leaf 66 therefrom in articulated fashion. As a result, the flat, stiff holder member 42 can be freely swung either toward the front cover 16, or toward the back cover 18 of the folder 12. This allows other papers to be inserted into the folder 12 on either side of the holder member 42 and to be easily accessible by merely folding the hinge 62 along its hinge fold line 72 to carry the magazine 44 out of the way.

Figure 5:
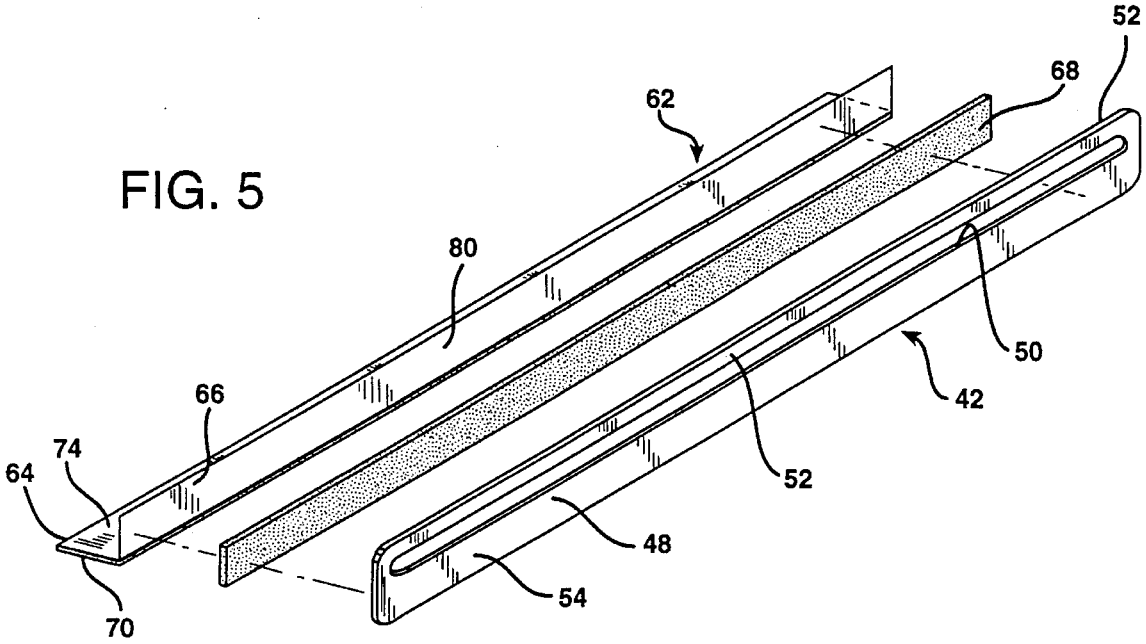
FIG. 5 is an exploded view illustrating the components of the document holder of FIGS. 3 and 4.

While different types of connection systems may be utilized to join the mounting leaf 66 of the hinge 62 to the attachment margin 54 of the holder strip 42, in embodiments of the system in which the hinge is formed of paper stock this connection is preferably achieved by coating the underside 80 of the attachment hinge leaf 66 with a layer of pressure sensitive adhesive 68 throughout its length, as best illustrated in FIG. 5. The adhesive layer 68 may thereupon be pressed firmly against the top side 46 of the holder strip 42 along the attachment margin 54 thereof to permanently secure the holder strip 42 to the attachment hinge leaf 66 of the hinge 62. If necessary, the interconnection between the attachment hinge leaf 66 and the holder strip 42 can be augmented by the use of staples or rivets through the attachment hinge leaf 66 and the holder strip 42.

The document holder 14 is preferably available as an insert which can be attached to any conventional office file folder, such as the folder 12. The adhesive layer 70 is secured to the underside 76 of the anchoring hinge leaf 64, but the opposite side of the adhesive layer 70 is initially protected from contact by a release film. When the document holder 14 is to be installed on the folder 12, the release film is stripped away from the adhesive layer 70 and the adhesive layer 70 is pressed into contract with the inside surface 22 of the front cover 16 adjacent the folder fold line 20, as shown in FIGS. 1 and 2.

Figure 6:
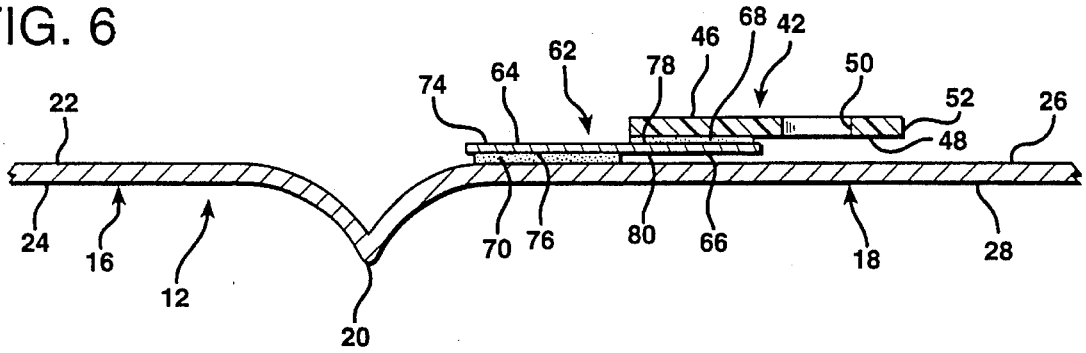
FIG. 6 is a sectional detail illustrating a variation of the combination of FIGS. 1 and 2.
Figure 7:
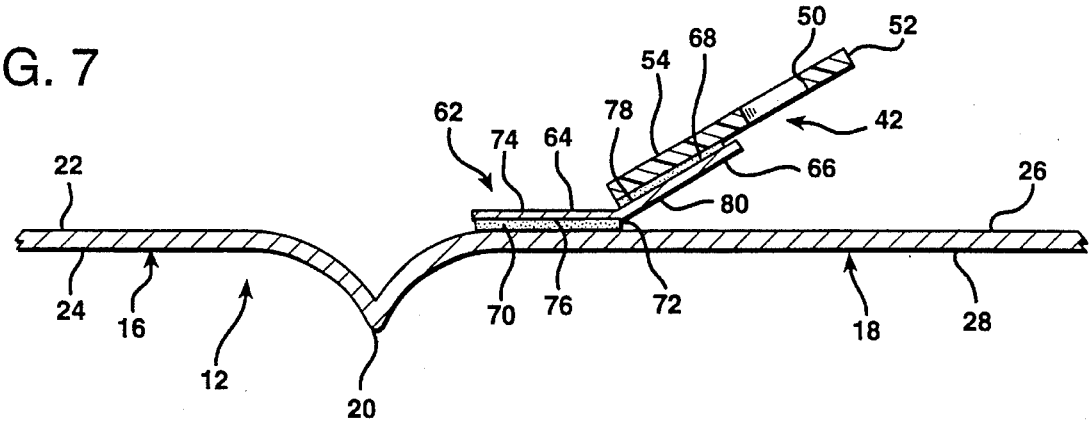
FIG. 7 illustrates the articulated movement of the leaves of the hinge employed in the combination of FIG. 6.

FIGS. 6 and 7 illustrate a variation of the manner of attachment of the document holder 14 to the file folder 12. In this embodiment the adhesive strip 70 on the underside 76 of the anchoring leaf 64 is pressed against and secured to the inside surface 26 of the back cover 18, rather than the front cover 16 of the folder 12. As in the embodiment of FIGS. 1 and 2, the attachment of the anchoring leaf 64 to the file folder 12 is proximate and parallel to the fold line 20 that forms the demarcation between the front cover 16 and the back cover 18 or the folder 12. Also as in the embodiment of FIGS. 1 and 2, the mounting or attachment leaf 66 is held in articulated fashion relative to the anchoring leaf 64. The adhesive layer 70 on the underside 76 of the anchoring leaf 64 secures the anchoring leaf 64 to the inside surface 26 of the back cover 18. The holder 14 is thereby firmly secured to the back cover 18 by the layer of adhesive 70.

Figure 8:
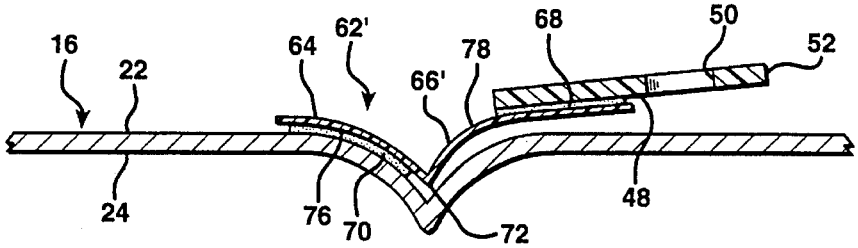
FIG. 8 illustrates an alternative embodiment of the document holder according to the invention.

FIG. 8 illustrates an alternative embodiment of the invention in which the mounting leaf 66' is considerably wider than the anchoring leaf 64 of the hinge 62'. With this arrangement the anchoring leaf 64 is secured at its underside 76 to the inside surface 22 of the front cover 16 by the adhesive layer 70. Unlike the arrangement of FIGS. 2, 6, and 7, the adhesive layer 68 joins the top surface 78 of the mounting leaf 66' to the undersurface 48 of the holder strip 42 along the attachment margin 54.

Figure 9:
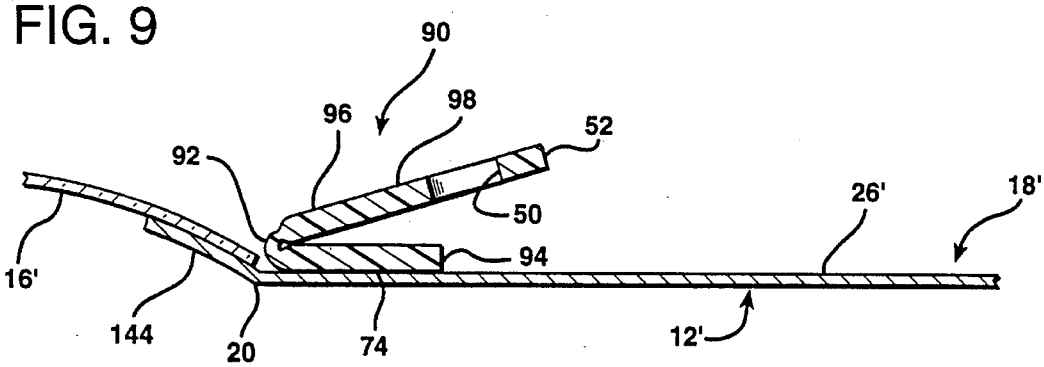
FIG. 9 illustrates still another alternative embodiment of a document holder according to the invention.

FIG. 9 illustrates still a further variation of the invention in which the anchoring leaf 94 and the mounting leaf 96 are folded to reside in back-to-back disposition relative to each other. FIG. 9 illustrates a document holder 90 in which the document holder strip and the hinge are all formed as a single, unitary structure from a strip of polyvinyl chloride, polypropylene, or polyethylene plastic. The document holder 90 has a longitudinal, linear region 92 of reduced thickness delineating the anchoring leaf 94 from the attachment leaf 96 of the hinge. The attachment leaf 96 extends laterally to integrally form the elongated holder strip 98 having the longitudinally elongated slot 50 defined therewithin in the manner previously described.

The holder leaves 94 and 96 are equal in thickness to each other and both have a thickness greater than the thickness of the region 92 of reduced thickness. In this way the hinge leaves 94 and 96 fold in articulated fashion relative to each other along the region 92 of reduced thickness in the manner often referred to as a "living hinge." The anchoring leaf 94 is constructed of polyvinyl chloride, polypropylene, or polyethylene plastic and the folder 12' has a compatible back cover 18', formed of polyvinyl chloride, polypropylene, or polyethylene as well. The anchoring hinge 94 is secured to the inside surface 26 of the back cover 18' of the folder 12' by heat sealing along the length of the surface 74. The surface 74 resides in contact throughout its length with the inside surface 26' of the back cover 18'.

Figure 10:
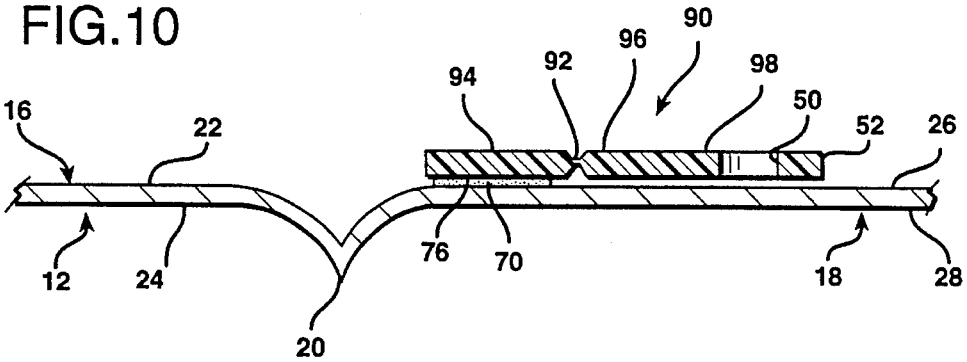
FIG. 10 illustrates still another alternative embodiment of a document holder according to the invention.
Figure 11:
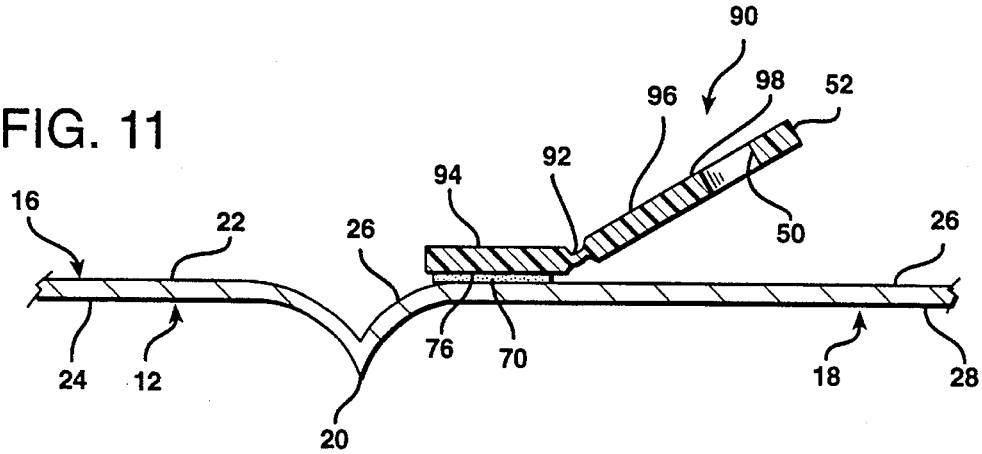
FIG. 11 illustrates the articulated movement of the embodiment of FIG. 10.

FIG. 10 illustrates another way in which the document holder 90 can be secured to the inside of the folder 12. In this arrangement the underside 76 of the anchoring leaf 94 is secured by the layer of adhesive 70 to the inside surface 26 of the back cover 18 of the folder 12. The mounting leaf 96 moves in articulated fashion relative to the anchoring leaf 94, as illustrated in FIG. 11.

Figure 12:
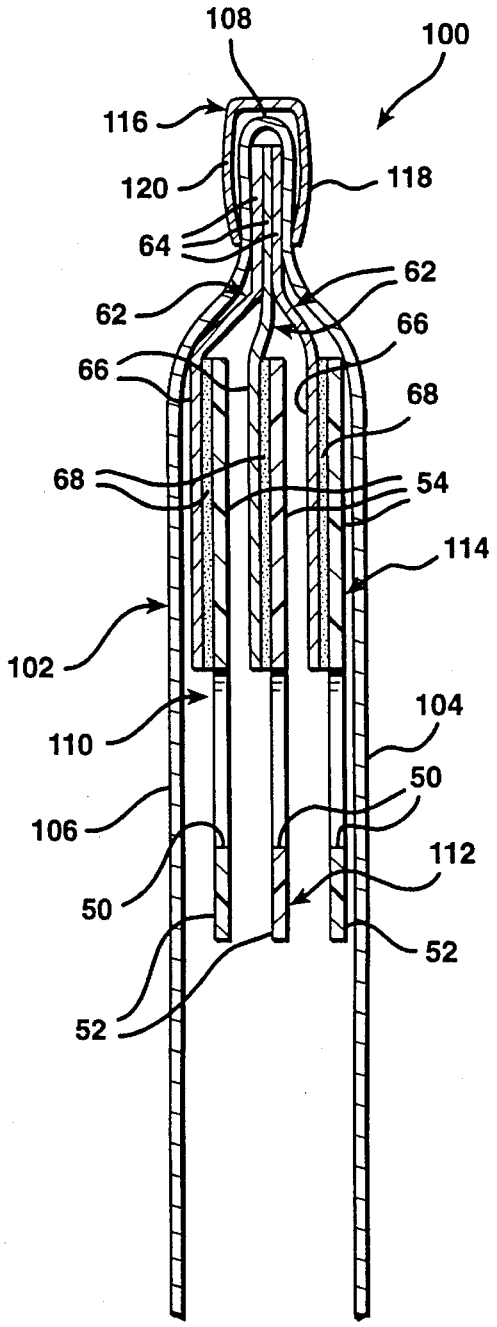
FIG. 12 is a sectional detail illustrating still another alternative embodiment of a combination according to the invention.

FIG. 12 illustrates another alternative embodiment of a folder and document holder combination 100. In this embodiment a folder 102 is formed with a front cover 104 and a back cover 106 which are delineated from each other by the fold line 108. This device employs a plurality of document holders 110, 112, and 114 which are all of identical construction to each other. The holders 110, 112, and 114 are all constructed in the manner of and have the same component parts as the holder 14 employed in the embodiment of FIGS. 1 and 2.

As illustrated in FIG. 12, the documents holders 110, 112, and 114 are all disposed in side-by-side relationship within the folder 102 between the front cover 104 and the back cover 106 thereof. In this embodiment no adhesive layers 70 are employed. Instead, a means for clamping the several document holders 110, 112, and 114 between the front cover 104 and back cover 106 is provided. Specifically, the combination 100 of FIG. 12 employs an elongated clasp 116 having a generally U-shaped uniform cross section throughout. The clasp 116 is configured as a stiff, resilient, channel-shaped clamp having opposing legs 118 and 120. The legs 118 and 120 of the clamp 116 span and grip the folder 102 and the anchoring leaves 64 of the hinges 62 therebetween and within the confines of the front cover 104 and back cover 106. The legs 118 and 120 of the clamp 116 thereby hold the anchoring leaves 64 of the hinges 62 immobilized between the front cover 104 and the back cover 106 through the force of friction.

Figure 13:
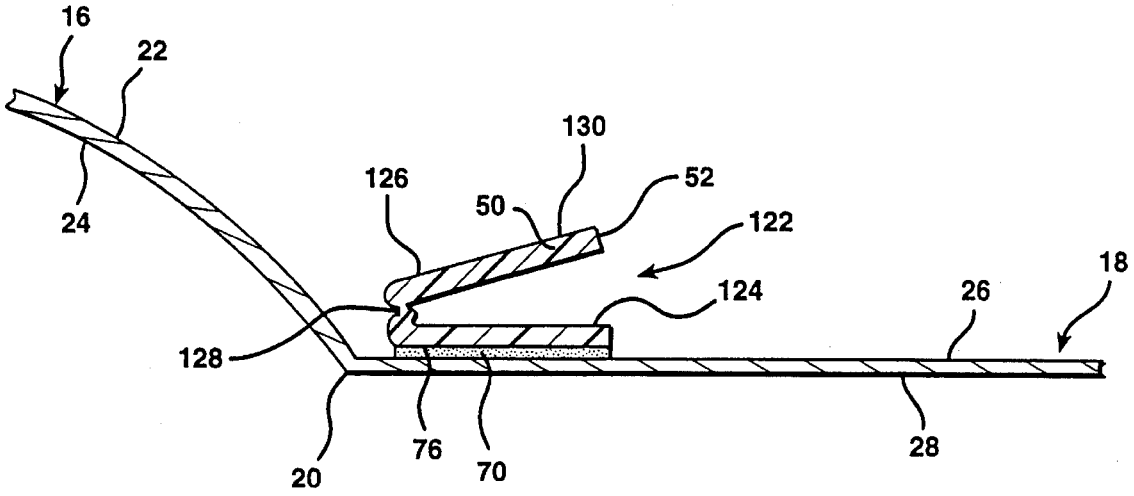
FIG. 13 is a sectional detail of still another alternative embodiment of the invention.

FIG. 13 illustrates still another embodiment of the invention employing a document holder 122 in which the hinge element and the document holding member are both formed as parts of a unitary, plastic, molded or die cut piece. The document holder 122 includes an anchoring leaf 124 separated from a mounting leaf 126 by a thin web of material 128 of reduced thickness. The web 128 thereby forms a "living hinge" between the hinge leaves 124 and 126. A lateral extension 130 of the hinge leaf 126 in the direction away from the web 128 serves as the document holding member and has a slot 50 defined therewithin and forms a document retaining bar 52 of the type described in conjunction with the embodiment of FIGS. 1 and 2. The underside 76 of the anchoring leaf 124 is secured to the top side 26 of the back cover 18 by the adhesive layer 70 or by other means proximate the fold demarcation 20 that delineates the front cover 16 from the back cover 18.

Figure 14:
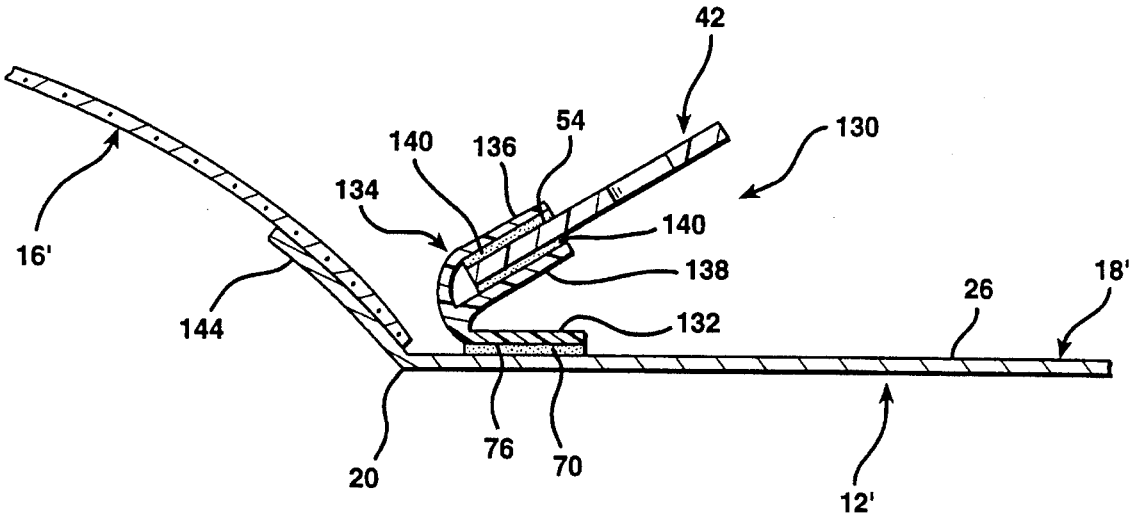
FIG. 14 is a sectional detail of still another alternative embodiment of the invention.

FIG. 14 illustrates still another embodiment of a holder 130 according to the invention. The holder 130 employs an anchoring leaf 132 that is secured by the adhesive layer 70 on its top side 76 to the inside surface 26 of the back cover 18 as in the embodiment of FIG. 13. The mounting leaf 134 of the holder 130 is formed as a bifurcated structure with a pair of longitudinally elongated arms 136 and 138 that project parallel to each other and away from the hinge connection between the mounting leaf 134 and the anchoring leaf 132. The arms 136 and 138 face each other and both have layers of adhesive 140 on their inner surfaces. The adhesive layers 140 secure the holder strip 144 between the mounting leaf arms 136 and 138 by adhesive bonds on both sides thereof. The mounting leaf arms 136 and 138 thereby grip the attachment margin 54 of the document holder 42 therebetween.

The embodiments of FIGS. 9 and 14 also differ from the other embodiments illustrated in that the front cover 16' thereof is not formed from the same sheet of material as the plastic, heat sealable back cover 18'. Rather, the front cover 16' is preferably a transparent plastic cover that is secured by heat sealing, staples, or adhesive to an attachment flange 144 of the sheet material forming the back cover 18'. The attachment flange 144 is located closely adjacent to the fold line 20 of the folder 12'. The front cover 16' and the back cover 18' are thereby formed of separate sheets of material, with the front cover 16' being formed of a transparent sheet of plastic while the back cover 18' is opaque.

Undoubtedly, numerous variations and modifications of the invention will become readily apparent to those familiar with office supply products. Accordingly, the scope of the invention should not be construed as limited the specific embodiments depicted and described herein.

I claim:

1. A holder for a soft-covered document comprising a flat, elongated strip of stiff material defining therethrough an elongated document slot bounded about its entire perimeter by said stiff material, said slot receiving some of said pages of said document therethrough such that they reside on one side of said strip while the remainder of said pages reside on the other side of said strip, and an elongated attachment hinge having an elongated longitudinally extending anchoring leaf and an elongated longitudinally extending holder attachment leaf wherein said holder attachment leaf is joined to said strip and said anchoring leaf has a layer of adhesive disposed thereon along its length, whereby said anchoring leaf is securable by adhesive to the inside of a folding cover.

2. A holder for a soft-covered document comprising a flat, elongated strip of stiff material defining therethrough an elongated document slot bounded about its entire perimeter by said stiff material, said slot receiving some of said pages of said document therethrough such that they reside on one side of said strip while the remainder of said pages reside on the other side of said strip, and an elongated attachment hinge having an elongated longitudinally extending anchoring leaf and an elongated longitudinally extending holder attachment leaf wherein said holder attachment leaf is joined to said strip and wherein said flat strip has a top side and an underside and said attachment hinge is formed as a unitary, thin structure in which said anchoring leaf has a top side and an underside and said attachment leaf has a top side and an underside, and wherein said underside of said attachment leaf is secured to said top side of said flat strip.

3. A holder according to claim 2 wherein said adhesive layer is disposed on said underside of said anchoring leaf and said attachment leaf and said anchoring leaf reside in side-by-side disposition relative to each other.

4. A holder according to claim 2 wherein said adhesive layer is disposed on said top side of said anchoring leaf and said anchoring leaf and said attachment leaf are folded to reside in back-to-back disposition relative to each other.

5. A holder according to claim 2 wherein said unitary structure is formed of a strip of plastic which has a longitudinal linear region of reduced thickness delineating said anchoring and attachment leaves from each other and wherein said leaves are of equal thickness that is greater than the thickness of said region of reduced thickness, whereby said hinge leaves fold in articulated fashion relative to each other along said region of reduced thickness.

6. A holder for a soft-covered document comprising a flat, elongated strip of stiff material defining therethrough an elongated document slot bounded about its entire perimeter by said stiff material, said slot receiving some of said pages of said document therethrough such that they reside on one side of said strip while the remainder of said pages reside on the other side of said strip, and an elongated attachment hinge having an elongated longitudinally extending anchoring leaf and an elongated longitudinally extending holder attachment leaf formed as a bifurcated structure with a pair of longitudinally elongated arms that grip said strip of stiff material therebetween, wherein said holder attachment leaf is joined to said strip.

7. A holder for a soft-covered document comprising a flat, elongated strip of stiff material defining therethrough an elongated document slot bounded about its entire perimeter by said stiff material, said slot receiving some of said pages of said document therethrough such that they reside on one side of said strip while the remainder of said pages reside on the other side of said strip, an elongated attachment hinge having an elongated longitudinally extending anchoring leaf and an elongated longitudinally extending holder attachment leaf and a layer of adhesive disposed between said attachment leaf and said flat strip, thereby joining and securing said holder attachment leaf to said flat strip.

8. In combination, a folder formed with front and back covers each having an inside and an exterior surface, an elongated holder for soft documents including a stiff, flat member defining entirely within its structure a narrow, elongated document slot that delineates an elongated document retaining bar and an attachment margin wherein said retaining bar and said attachment margin are joined together at opposite longitudinally separated ends, and wherein said document holder further includes an elongated hinge with an elongated, anchoring leaf and an elongated mounting leaf disposed parallel to said anchoring leaf and joined thereto in articulated fashion, wherein said mounting leaf is joined throughout its length to said attachment margin of said stiff, flat member and said anchoring leaf is secured throughout its length to at least one of said inside surfaces of said front and back covers.

9. A combination according to claim 8 wherein said stiff, flat member has a top side and an underside and said elongated hinge is formed as a unitary, thin structure with said anchoring leaf having a top side and an underside and said attachment leaf having a top side and an underside.

10. A combination according to claim 9 wherein said anchoring leaf has a layer of adhesive on its underside and is secured to said inside surface of said back cover by said layer of adhesive.

11. A combination according to claim 9 wherein said anchoring leaf has a layer of adhesive on its underside and is secured to said inside surface of said front cover by said layer of adhesive.

12. A combination according to claim 9 wherein said anchoring leaf and said mounting leaf are folded to reside in back-to-back disposition relative to each other and said anchoring leaf has a layer of adhesive on its top side and is secured to said inside surface of said back cover by said layer of adhesive.

13. A combination according to claim 12 wherein said attachment leaf is formed as a bifurcated structure with a pair of longitudinally elongated arms that grip said stiff, flat member therebetween.

14. A holder according to claim 9 wherein said hinge is a unitary structure formed of a strip of plastic which has a longitudinal linear region of reduced thickness delineating said anchoring and attachment leaves from each other and wherein said leaves are of equal thickness greater than the thickness of said region of reduced thickness, whereby said hinge leaves fold in articulated fashion relative to each other along said region of reduced thickness, and wherein said anchoring leaf is secured by a layer of adhesive to said inside surface of said back cover.

15. A combination according to claim 8 wherein said anchoring leaf is secured to said folder by heat sealing.

16. A combination according to claim 8 wherein said front and back covers are formed of separate sheets of material, and said front cover is formed of a transparent sheet of plastic.

17. A combination according to claim 8 further comprising a plurality of holders for soft documents as aforesaid disposed in side-by-side relationship within said folder between said front and back covers thereof and further comprising means for clamping said plurality of holders for soft documents together between said front and back covers.

18. An insert for a folder having front and back covers comprising a holder for a multipage document formed with a stiff, elongated strip having longitudinally opposite ends and opposite flat sides and defining therewithin and therethrough a narrow, elongated document slot of a size that receives therethrough a substantial number of pages of said document such that said substantial number of pages project from one of said sides of said strip and the remaining pages of said document project from the other of said sides of said strip, and an attachment hinge joined to said strip and having an elongated, longitudinally extending anchoring leaf and an elongated, longitudinally extending attachment leaf, and wherein said attachment leaf is secured to said strip along its length and wherein said anchoring leaf has a layer of adhesive disposed thereon for adhesive attachment to one of said covers of said folder.

* * * * *